US006533195B2

(12) United States Patent
Sinders

(10) Patent No.: US 6,533,195 B2
(45) Date of Patent: Mar. 18, 2003

(54) VARIABLE ANGLE AIRLESS NOZZLE AND DISPENSING METHOD

(75) Inventor: Steven Sinders, Mooresville, IN (US)

(73) Assignee: Glas-Craft, Inc., Indianapolis, IN (US)

( * ) Notice: Subject to any disclaimer, the term of this patent is extended or adjusted under 35 U.S.C. 154(b) by 0 days.

(21) Appl. No.: 09/769,675

(22) Filed: Jan. 25, 2001

(65) Prior Publication Data

US 2002/0096579 A1 Jul. 25, 2002

Related U.S. Application Data

(63) Continuation-in-part of application No. 09/578,608, filed on May 25, 2000, now abandoned.

(51) Int. Cl.[7] ..... A62C 31/00; B05B 1/14; B05B 17/04

(52) U.S. Cl. ..... 239/398; 239/265.19; 239/265.23; 239/265.25; 239/11

(58) Field of Search ..... 239/398, 406, 239/413, 434.5, 433, 416.4, 416.5, 407, 417.3, 418, 419, 424.5, 429, 417.5, 582.1, 569, 543, 544, 580, 465, 88, 91, 265.25, 265.23, 265.19, 11

(56) References Cited

U.S. PATENT DOCUMENTS

| | | | | | |
|---|---|---|---|---|---|
| 1,285,952 | A | * | 11/1918 | De Ros | 239/544 |
| 2,786,716 | A | * | 3/1957 | Peeps | 239/419 |
| 2,893,646 | A | * | 7/1959 | Batts | 239/433 |
| 3,790,030 | A | | 2/1974 | Ives | 222/135 |
| 3,799,403 | A | | 3/1974 | Probst et al. | 222/135 |
| 3,873,023 | A | | 3/1975 | Moss et al. | 239/3 |
| 3,908,903 | A | * | 9/1975 | Burns, Jr. | 239/406 |
| 4,123,007 | A | | 10/1978 | Gardner | 239/414 |
| RE30,486 | E | | 1/1981 | Beck | |
| 4,428,530 | A | | 1/1984 | Chabria | |
| 4,760,956 | A | | 8/1988 | Mansfield | 239/8 |
| 5,080,283 | A | | 1/1992 | Kukesh et al. | 239/9 |
| 5,080,286 | A | | 1/1992 | Morrison | |
| 5,267,693 | A | * | 12/1993 | Dickey | 239/417.3 |
| 5,372,283 | A | | 12/1994 | Schmitkons et al. | 222/145 |
| 5,678,764 | A | | 10/1997 | Kukesh | 239/399 |
| 5,944,507 | A | * | 8/1999 | Feldermann | 239/424 |
| 6,076,750 | A | | 6/2000 | Mykkanen et al. | |

FOREIGN PATENT DOCUMENTS

| | | |
|---|---|---|
| FR | 1407782 | 6/1964 |
| GB | 1029521 | 5/1966 |

* cited by examiner

*Primary Examiner*—Michael Mar
*Assistant Examiner*—Davis Hwu
(74) *Attorney, Agent, or Firm*—Brinks Hofer Gilson & Lione

(57) ABSTRACT

In an airless dispensing system, liquids may be dispensed at variable angles from substantially 0° to as much as 50°–60°, by a simple adjustment made by a dispenser operator without ceasing operation or disassembling the dispenser apparatus. A variable angle liquid dispenser comprises a nozzle having a forward face with a dispensing orifice, a first passageway in the nozzle having a central axis intersecting the dispensing orifice, a plurality of angled second passageways in the nozzle, each angled second passageway having a central axis intersecting the dispensing orifice and the central axis of the first passageway, and a variable flow control adjustable to vary the flows of liquid entering the first passageway and the plurality of angled second passageways and to thereby vary the included angle of the liquid dispensed from the dispensing orifice and the width of liquid that may be applied to a substrate.

30 Claims, 7 Drawing Sheets

VARIABLE ANGLE AIRLESS NOZZLE AND DISPENSING METHOD

This application is a continuation-in-part of U.S. patent application Ser. No. 09/578,608, filed May 25, 2000, now abandoned.

FIELD OF THE INVENTION

This invention relates to liquid dispensing apparatus and methods, and more particularly to airless liquid dispensing nozzles and methods.

BACKGROUND OF THE INVENTION

Liquid dispensing systems include methods and apparatus using compressed air to atomize and shape a spray pattern for application to a substrate, and airless liquid dispensing systems in which liquid is forced through a nozzle, frequently at high fluid pressures, in an expanding fan-like sheet for atomization and application to a substrate, and also airless liquid dispensing systems in which liquid streams are directed from a nozzle for impingement and the formation of an expanding fan-like sheet in air.

Compressed air spraying and dispensing systems, while providing flexibility in operation and variability in the shape and angle of a spray pattern through the adjustment of compressed air jets from a plurality of orifices in the dispensing nozzle, suffers a serious disadvantage because of liquid spray particles and vapors which are blown away from the substrate and into the operating environment, frequently in violation of regulations for safe operation and protection of the environment.

Airless liquid dispensing systems suffer from a lack of flexibility during their operation. Airless liquid dispensing nozzles are designed to dispense liquid in a substantially constant and pre-selected angle of dispersion. Thus, if during operation it becomes desirable to change the width of liquid being dispensed from an airless operating system, it has been necessary to stop operation of the system, remove the nozzle being used, and replace it with a nozzle providing a more desirable angle of dispersion. This is inconvenient and time consuming, frequently requiring cleaning of the dispensing apparatus and nozzle.

The ability to vary the width of liquid being dispensed and applied to a substrate while continuing dispensing is of particular value in the application of plural component materials, such as polyesters in gel-coat, spray-up, and wet-out operations. In many such operations, the substrates and molds to which plural component materials, such as polyesters are being applied, present varied and complex shapes, frequently with channels and corners. The ability to apply, for example, polyester materials, in narrow widths to channels and corners, and in wide widths to larger, planar areas of a mold can assist the equipment operator in obtaining quick, complete and uniform coverage of the substrate or mold, and effective wet-out of reinforcing glass fibers or mat.

BRIEF SUMMARY OF THE INVENTION

The invention provides an airless dispensing system in which liquids may be dispensed with variable included angles from substantially 0° to as much as 50°–60°, by a simple adjustment made by a dispenser operator without ceasing operation or disassembling the dispenser apparatus.

In the invention, a variable angle liquid dispenser comprises a nozzle having a forward face with a dispensing orifice, a first passageway in the nozzle having a central axis intersecting the dispensing orifice, a plurality of angled second passageways in the nozzle, each angled second passageway having a central axis intersecting the dispensing orifice and the central axis of the first passageway, and a variable flow means adjustable to vary the flows of liquid entering the first passageway and the plurality of angled second passageways and to thereby vary the included angle of the liquid dispensed from the dispensing orifice.

Variable angle liquid dispensers of the invention can comprise two major elements, a nozzle body forming the forward face, the dispensing orifice, the first passageway and the plurality of intersecting angled second passageways, and variable flow means comprising a body forming an input passageway and carrying a variable flow splitter between the input passageway and the passageways of the nozzle body. In one preferred embodiment, the variable flow means comprises an assembly including a flow divider body forming an input passageway leading to the first passageway and the plurality of angled second passageways of the nozzle, and a valve member movably carried by the body to provide a variable flow division between the first passageways and plurality of angled second passageways of the nozzle. A preferred flow divider body can have a forward portion that is adapted for sealed engagement with the nozzle body, can provide a seal between the first passageway and the plurality of angled second passageways, and can provide a first feed passageway between the input passageway and the first passageway of the nozzle body, and a second feed passageway with an entrance opening between the input passageway and the angled second passageways of the nozzle body. The valve member can be threadably and rotatably carried by the flow splitter body and can be moved variably with respect to the entrance opening of the second feed passageway to provide a variable flow division between the first feed passageway and the second feed passageway, thereby varying the portions of the liquid flowing in the input passageway that flow through the first passageway and angled second passageways of the nozzle.

One preferred nozzle body of the invention includes a plurality of passageways converging adjacent the dispensing orifice. A first passageway lies on the central axis of the nozzle body and two angled second passageways have their central axes lying outboard in the same plane as the central axis of the first passageway, and converging with an included angle of from about 25° to about 50° between them. The first passageway has a diameter about 25% to about 75%, preferably about 70% of the diameters of the angled second passageways and a central axis bisects the central axes of the two outboard passageways.

In one preferred method of the invention, flows of the two components of a plural component material, such as a polyester resin and a catalyst therefor, are directed, under pressure, from their sources for mixing and dispensing from a nozzle having a plurality of passageways, at least two of the nozzle passageways being angled, with their central axes converging at an included angle, for example, from about 25° to about 50°, and with a central nozzle passageway bisecting the converging central axes of the two angled outboard passageways. The flow rates of the two components are controlled to provide desired flow rates for proper mixing, for example, a catalyst flow rate about 0.5% to about 10% of the flow rate of a polyester resin, and the two liquid components catalyst are mixed, while flowing, and the flowing mixed liquid components are directed to the plurality of passageways of the nozzle and are dispensed from the nozzle as combined and mixing streams, forming an expanding, substantially planar stream of further mixed two-component material for application to a substrate. The flow of mixed two-component material is variably divided between the at least two angled outboard passageways and the central passageway, and the included angle of liquid dispensed from the dispensing nozzle is varied from substantially 0° to about 50°, varying the width of mixed plural component material applied to the substrate.

Other features and advantages of the invention will be apparent from the attached drawings and more detailed description of the currently known best mode of the invention, which follows.

BRIEF DESCRIPTION OF THE DRAWINGS

FIG. 3B being a front view from the left of FIG. 3A; and FIG. 3C being a rear view from the right of FIG. 3A.

FIG. 8A being a front view; FIG. 8B being a side view; FIG. 5C being a rear view; and FIG. 8D being a cross-sectional view taken at a plane through line 100—100 of FIG. 8C.

DETAILED DESCRIPTION OF THE BEST MODE OF THE INVENTION

Figure 1:
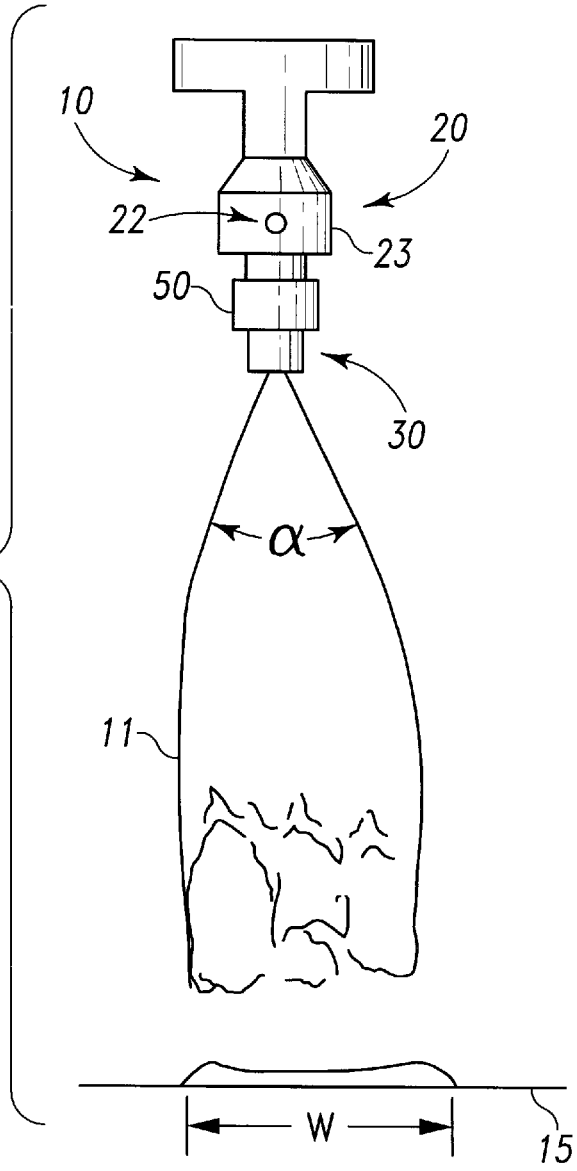
FIG. 1 is a diagrammatic illustration of one aspect of a method of the invention as viewed from the front or back when, for example, material is being dispensed downwardly.
Figure 2:
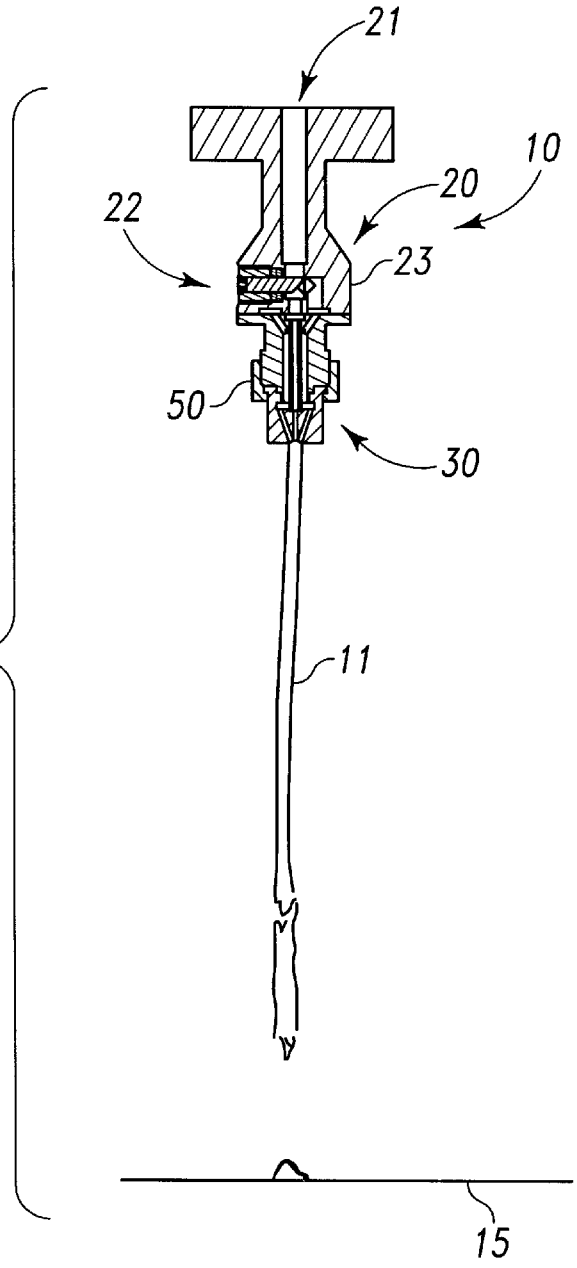
FIG. 2 is a diagrammatic illustration of the method illustrated in FIG. 1, taken at 90° from the view of FIG. 1.

FIGS. 1 and 2 illustrate a variable angle liquid dispensing apparatus and method of the invention. The variable angle liquid dispensing apparatus 10 of the invention combines a variable flow control means 20 and a nozzle 30, preferred embodiments of which are shown in cross-section in FIG. 2, and further illustrated and described with respect to FIGS. 3–8. Such variable angle liquid dispensing apparatus are particularly desirable in the application of two-component materials, such as in polyester spray-up and wet-out operations.

As illustrated by FIGS. 1 and 2, for example, mixed components of a two-component material, such as a polyester resin and a catalyst therefor, are delivered to an input passageway 21 of variable flow control means 20, and are dispensed from the dispensing nozzle 30 for deposition on a substrate 15. The two components of the plural component material are preferably mixed in the input passageway 21, but may be mixed before they reach the input passageway 21. The two components are further mixed by the action of the variable flow control means 20 and nozzle 30 prior to their deposition on the substrate 15. As illustrated by FIGS. 1 and 2, the dispensing nozzle 30 combines a plurality of streams of mixed material as they exit the nozzle 30 to form an expanding, substantially planar liquid stream 11 that extends from the nozzle 30 a distance of at least several inches in sheet-like form, substantially without the formation of small particles of material that can be carried away by air movement. In the invention, through adjustment of the variable flow control means 20, the stream 11 that extends from the nozzle can, during operation of the apparatus 10, be varied from a substantially round, columnar stream to an expanding, substantially planar stream, having a variable included angle $\alpha$ and providing variable width "W" of material deposited on the substrate 15, illustrated in FIG. 1. In the invention, the plurality of streams of material are contained within the nozzle until they are combined, and their interaction remains controlled and free from disturbing influence by the wind.

During operation of the apparatus 10, the angle $\alpha$ of the dispensed stream 11 and the width "W" deposited on the substrate 15 can be varied by adjustment of the variable flow control means 20, as described below, while material is being dispensed and without changing the nozzle 30.

Figure 3C:
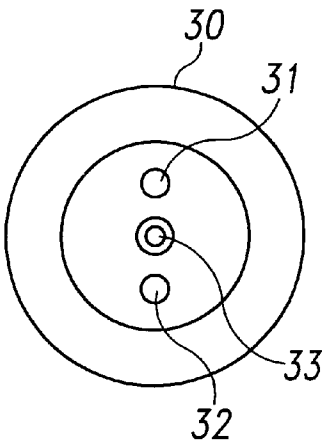
FIGS. 3A, 3B and 3C illustrate a dispensing nozzle used in the invention, FIG. 3A being a cross-sectional view taken at a plane 3A—3A through the central axes of the nozzle body and its three passageways.
Figure 3A:
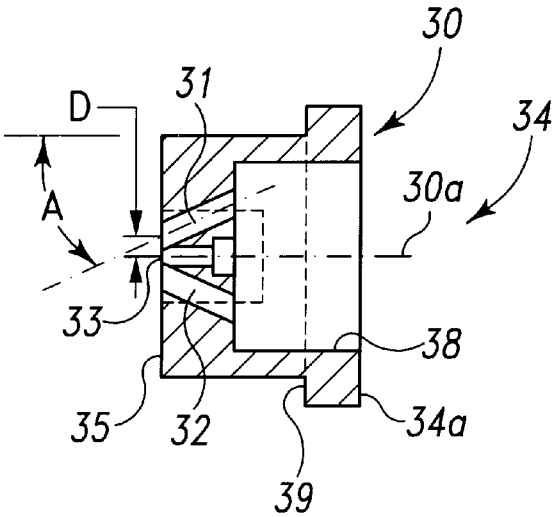
Figure 3B:
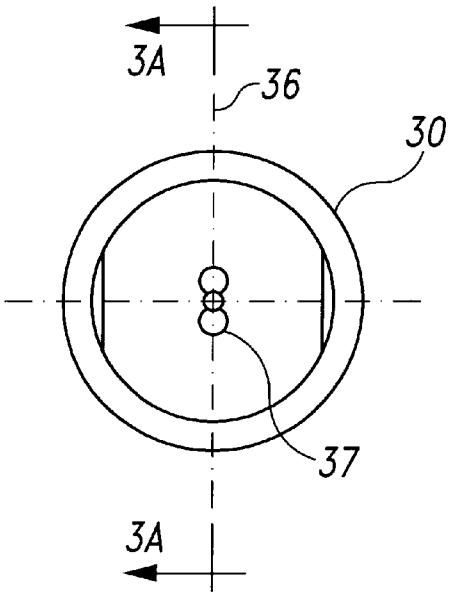

FIGS. 3A, 3B, and 3C illustrate in greater detail a dispensing nozzle 30 used in the invention. As illustrated in FIGS. 3A–3C, the nozzle body 30 is provided with a first passageway 33 and a plurality of angled second passageways 31, 32 extending from its rear 34 to its forward face 35. The plural angled passageways 31 and 32 lie on a plane 36, including the central axis 30*a* of the nozzle body 30, and are angled with respect to the central axis at an angle "A" so that their central axes converge substantially at the front face of the nozzle body 30 at the included convergence angle "2A," which is preferably from about 25° to about 50°; that is, the angle "A" between the central axes of passageways 31 and 32 and the central axis 30*a* of the nozzle body 30 are preferably from about 12°to about 25°. The first passageway 33 lies on the central axis 30*a* and intersects passageways 31 and 32 just behind the forward face 35 of nozzle 30. The three passageways 31, 32 and 33 form a single elongate opening 37 in the nozzle front face 35. In the nozzle 30, the distance "D" between the central axes of the passageways 31 and 32 and the central axis 30*a* at the front face 35 of the nozzle can be from about 25% to about 75% of the diameter of the passageways 31 and 32, and is preferably about 70% of the diameters of passageways 31 and 32. The rear 34 of the nozzle body 30 includes a cylindrical cavity 38 and a flange 39, which is engageable by a threaded end cap 50 so that it may be maintained on a dispenser body.

Figure 4:
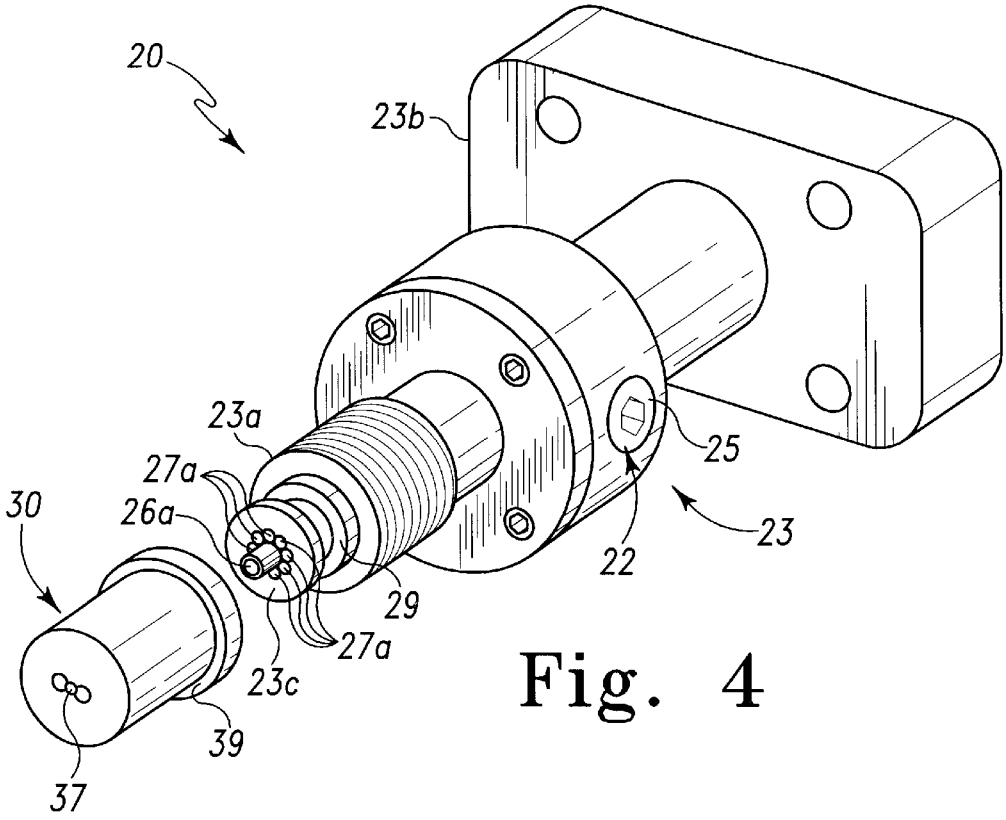
FIG. 4 is a perspective view of a preferred combination of nozzle and variable flow means of a variable angle liquid dispenser assembly of the invention.
Figure 5:
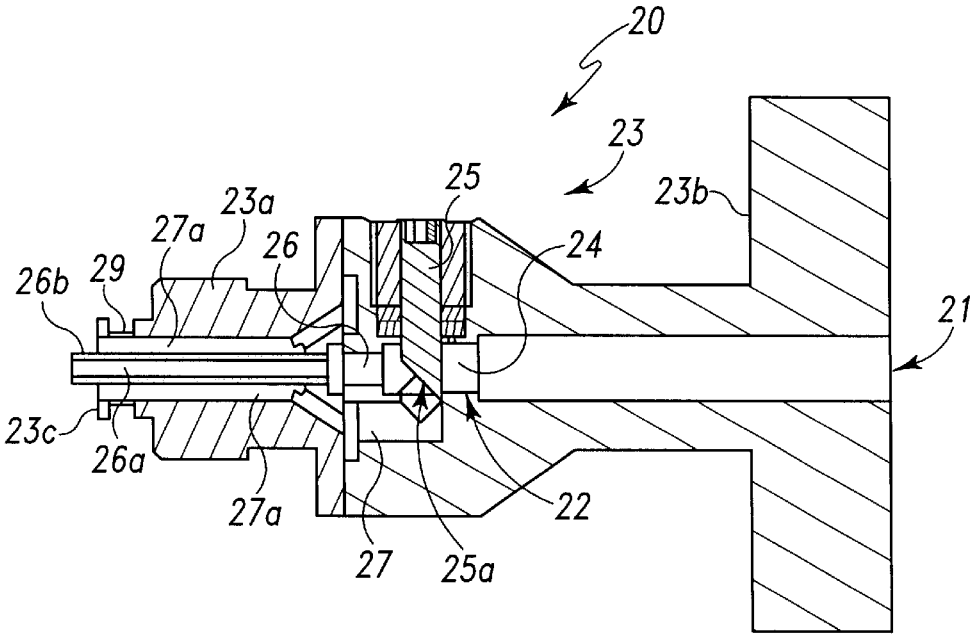
FIG. 5 is a cross-section of the variable angle liquid dispenser assembly of FIG. 4 at a vertical plane through the central axis of the variable angle liquid dispenser assembly of FIG. 4.

FIG. 4 is a perspective view of the preferred combination 10 of nozzle 30 and variable flow control means 20, with the nozzle 30 removed from the front portion of the variable flow control means 20 (without showing the retention nut 50 that retains nozzle 30 on the forward end of the variable flow control means 20.) Variable flow control means 20 provides a means for varying flow of material in the angled second passageways 31, 32 and the first passageway 33 of the nozzle 30 (FIG. 3A). The variable flow control means 20 preferably comprises a body 23, including a forward portion 23*a* and a rear portion 23*b*, which may themselves comprise separate pieces, as shown in FIGS. 4–8. FIG. 5 is a cross-sectional view of the variable flow control means 20, taken at a vertical plane through its central axis, to illustrate a means forming a variable flow splitter 22.

Figure 6:
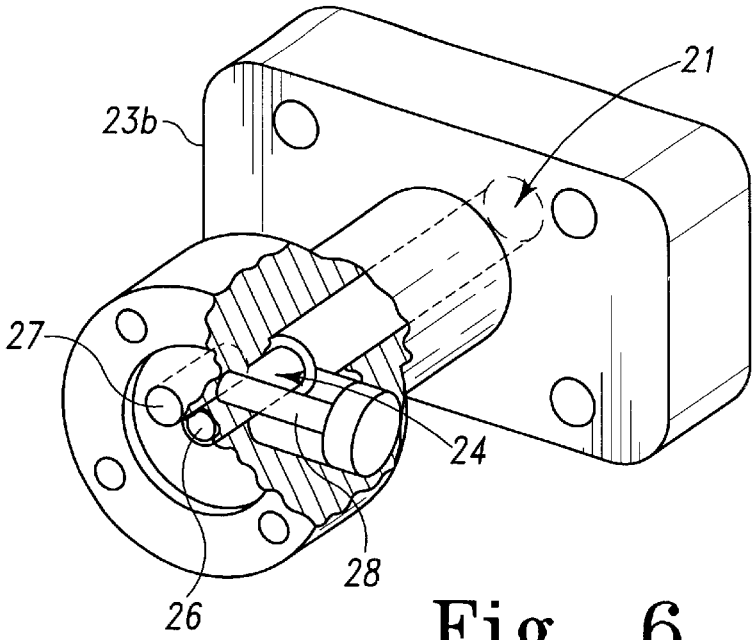
FIG. 6 is a perspective view, partially broken away, of the variable flow means body portion of the variable angle liquid dispenser of FIGS. 4 and 5.
Figure 7A:
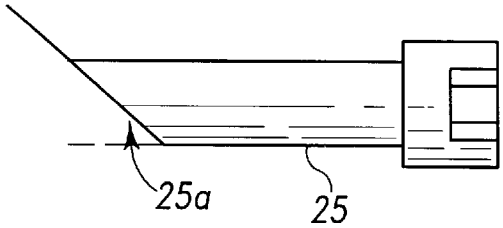
FIGS. 7A and 7B are a side view and an end view, respectively, of the variable valve element of the variable angle liquid dispenser assembly of FIGS. 4–6.
Figure 7B:
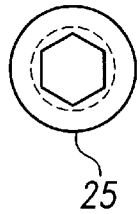
Figure 8C:
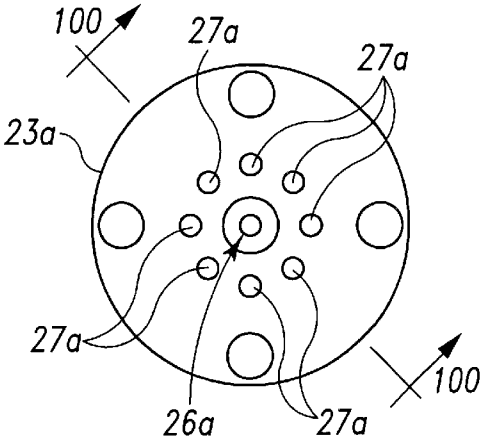
FIGS. 8A–8D are views of the forward portion of the variable flow means body portion of the variable angle liquid dispenser of FIGS. 4–6.
Figure 8B:
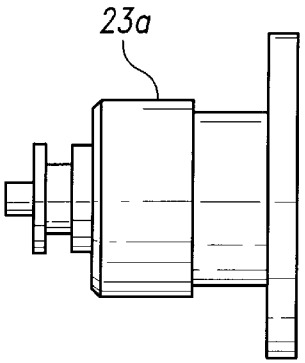
Figure 8A:
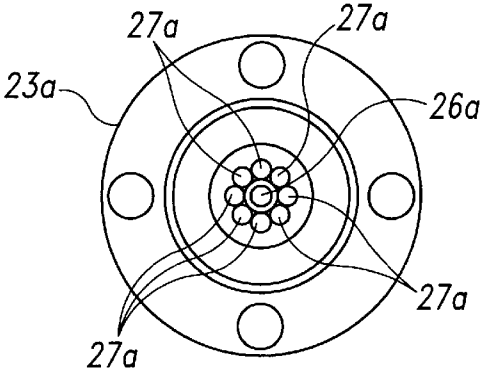
Figure 8D:
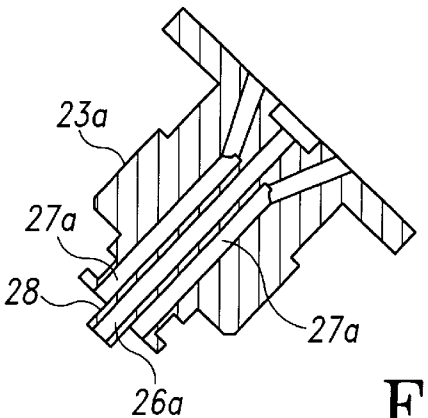

As indicated in FIGS. 5 and 6, the rear portion 23*b* of the body 23 forms an input passageway 21 which leads forwardly to the variable flow splitter 22. The input passageway 21 preferably carries a static mixer (not shown), such as that sold by TAH Industries, Inc. of Imalaystown, N.J. 08526, as their Part No. 121-216. A movable valve member 25, shown in FIGS. 7A and 7B, which has a smaller diameter than input passageway 21, is threadably carried in a threaded hole 28 in the valve body 23*b*, in a direction transverse to the direction of the input passageway 21, and the wall forming input passageway 21 includes an opening 24 leading to angled second passageways 31, 32 so that the forward end 25*a* of valve member 25 can be adjustably positioned with respect to the orifice 24 as the variable valve member 25 is rotated. As indicated in FIGS. 5 and 7A, the forward portion 25*a* of the variable valve member 25 preferably comprises an angled, chisel-like, face 25A which can be adjustably moved into and out of the opening 24 as the valve member 25 is threaded into and out of the body 23, so that valve member end 25A and opening 24 form a flow control valve for the angled second passageways 31, 32, and can vary the flow of material in the input passageway 21 entering a first feed passageway 26 in communication with the first passageway 33 of the nozzle 30 and a second feed passageway 27, in communication with the angled second passageways 31, 32 of the nozzle 30. (See FIGS. 5 AND 6).

For convenience of manufacture, the forward portion 23*a* of the flow splitter body 23 is formed as a separate piece shown, for example, in FIGS. 8A–8D, which is fastened by threaded fasteners at the forward end of the rear portion 23*b* of the body 23. The forward portion 23*a* of the body 23 includes a forward extension 26*a* of the first feed passageway 26, extending into a tip 26*b* which extends into the rear of nozzle 30 for sealed engagement with the first passageway 33 of the nozzle 30. The forward portion 23*a* also includes a plurality of second feed passageway extensions 27*a*, which open in the forward face 23*c* of the forward portion 23*a* of the flow splitter body 23, adjacent the first feed passageway extension 26*a*. The forward portion 23*a* also forms an o-ring groove 29 rearwardly of its front face 23*c* so placement of an o-ring (not shown) in the o-ring groove 29 can provide a seal between the forward portion 23*a* of the flow splitter body 23 and the walls of the cylindrical cavity 38, formed at the rear of the nozzle 30, so that flow from the second feed passageways extension 27*a* is forced through the angled second passageways 31, 32 of the nozzle 30.

In operation of the illustrated variable flow control means 20 when the flow control valve member 25 is threaded inwardly so that its forward portion 25*a* extends into opening 24, substantially the entire flow of liquid material entering the input passageway 21 flows outwardly around the valve element 25 and through the first feed passageway 26 and its extension 26*a* in the forward portion 23*a* of the flow splitter body and through the first passageway 33 of the nozzle body to be dispersed outwardly from the nozzle orifice 37 in a substantially non-expanding columnar form, i.e., having a substantially circular cross-section with an a of about 0°. As the variable flow control valve member 25 is threaded outwardly so its forward portion 25*a* is variably removed from the opening 24, the flow of liquid material entering the input passageway 21 is variably split between the first feed passageway 26 and second feed passageway 27 and their extensions 26*a* and 27*a*, respectively, in the forward portion 23*a* of the body 23, and the flow of material through the first passageway 33 is reduced, and flows of material are introduced to, and increased in, the angled second passageways 31, 32 of the nozzle 30, creating a dispensed liquid material that becomes a substantially planar stream, with an increasing included angle $\alpha$ and an increasing width W of deposition on the substrate 15. The flow control valve member 25 may be rotated in the body 23 while material is being dispensed from the nozzle 30 and deposited on the substrate 15, and an equipment operator can visually determine the width of deposited material most desirable for the substrate and can, if desired, create a non-expanding stream for injection into narrow channels and passageways, eliminating the need to stop dispensing operations and to change nozzles for deposition on complexly shaped substrates.

The rear portion 23*b* of the variable flow control means 20 can be connected to the forward end of a dispensing apparatus 80 such as the GLAS-CRAFT INDY II™ gun, manufactured by Glas-Craft, Inc. of Indianapolis, Ind., its Part No. 23500-00.

In the preferred nozzle example shown in FIGS. 3A–3C, preferred diameters of the angled passageways 31 and 32 are from about 0.040 inches to about 0.090 inches, preferably about 0.07 to about 0.08 inches, and the diameter of the central passageway 33 is about 70% of the diameters of the two angled passageways, preferably about 0.052 to about 0.055 inches. Nozzle 30 is 0.40 inches long from its front face 35 to its rear face 34*a*, the outer diameter at flange 59 is 0.890 inches and the outer diameter is 0.437 inches at the front face. The cylindrical cavity 38 at the rear of the nozzle has a depth of 0.250 inches and a diameter of 0.375 inches. The distance 2D between the central axes of passageways 31 and 32 at the front face 35 of the nozzle is about 150 percent of their diameters, and the diameter of the central passageway 33 is about 70 percent of the diameters of passageways 31 and 32, thereby forming a single elongated opening 37 in the front face of the nozzle.

In a method of depositing a catalyzed polyester resin with the invention, the polyester resin and catalyst can be pressurized to a pressure of from about 100 psi to about 700 psi, preferably from about 120 psi to about 500 psi, and their flow rates controlled to provide a catalyst flow that is about 0.5 percent to about 10 percent of the flow rate of the polyester resin.

Figure 9:
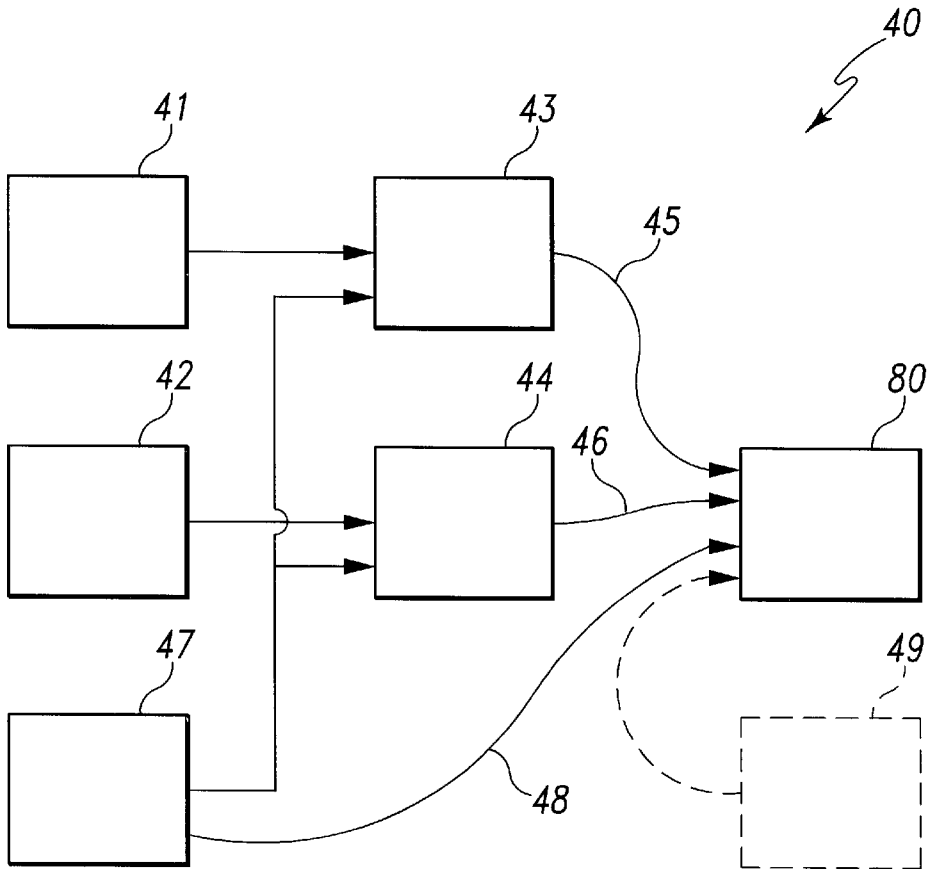
FIG. 9 is a diagram of the system for practicing the invention.

FIG. 9 illustrates, in diagrammatic form, a system 40 for practicing the method of the invention with, for example, a hand-held dispensing gun 80, such as the GLAS-CRAFT INDY II™, Part No. 23500-00, available from Glas-Craft, Inc. of Indianapolis, Ind., dispensing a catalyzed polyester resin. The system 40 includes a source 41 of polyester resin and a source 42 of catalyst for the polyester resin, and air-driven pumps 43 and 44 to pressurize and provide flows of the polyester resin and catalyst, respectively. Pumps 43 and 44 are operated to provide controllable and controlled flows of the polyester resin and catalyst. Preferably, the pump 44 is operated to provide a catalyst flow rate that is 0.5 percent to about 10 percent of the flow rate of the polyester resin, depending upon the specific two-component polyester material being applied. Flexible hoses 45 and 46 provide the flows of the components to the dispenser 80. A source 47 of compressed air is also provided to the dispenser 80 through a further flexible hose 48. A source of cleaning solvent 49 may also be provided.

The dispenser gun 80 can include a mixer carried within the gun at its forward end adjacent a variable flow control means mounting flange in addition to, or in place of, a static mixer carried in the input passageway 21 of the flow splitter body 23. Preferably, the polyester resin and catalyst are separately carried within the dispenser gun 80 to the input passageway 21 of the flow splitter body where they are first mixed, and their flows are controlled by a trigger that is operated to turn the application of the mixed polyester and catalyst materials on and off. Such dispensing guns are well known in the art and are available from several companies, including Glas-Craft, Inc. of Indianapolis, Ind.

Upon completion of its use, the dispenser 80, including the variable flow control means 20 and nozzle 30, can be cleaned of catalyzed polyester resin by the application of compressed air from source 47 and/or a flow of solvent from source 49.

EXAMPLE

An example of the application of a two-component polyester material follows.

A two-part polyester resin material, including a polyester resin and methyl ethyl ketone peroxide, is applied to mold surface with the apparatus described above. The first component is a polyester material, which contains a polyester resin, styrene monomer and an amorphous silicon dioxide. The viscosity of the liquid portion of the material can have range of 100 to 600 centipoise, but this viscosity can be increased by the use of the silicon dioxide filler to 1500 centipoise. The second component is methyl ethyl ketone peroxide, which, when added to the resin, acts as a catalyst to promote hardening. The ratio of the two components range from 100 parts of resin to 0.5 parts to 10 parts of the methyl ethyl ketone peroxide. As the ratio of the catalyst portion of the two mixed materials increases, the time required for the material to harden decreases. A pressure of about 210 psi is applied to both components. The dispensing nozzle 30 includes converging angled passageways 31, 32 having a diameter of about 0.07 inches and a convergence angle of about 50°, and a central passageway 33 has a diameter of about 0.052 inches. The dispenser 80, a GLAS-CRAFT INDY II™ gun, is manipulated about 28 to 32 inches above the mold surface, with dispensing controlled by actuation of a trigger, and the flow control valve member 25 is adjusted so the mixed resin material is first applied to the mold surface in a multiple passes 18 to 20 inches wide, blended by the operator for uniformity. By adjusting the flow control valve member 25, the width of the material applied to the mold surface is reduced to a width of 9 to 10 inches for application to narrower mold portions. The application rate is about 8 to 10 pounds of resin per minute, but higher application rates are possible with increased passageway sizes in the nozzle and increased pressures. No significant polyester resin escapes the application area.

Thus, the invention permits an improved dispensation of fluid materials, such as in the application of two-component polyester materials in the manufacture of articles. The invention provides convenient variation in the included angle and deposited width of dispensed fluid material without ceasing dispensing operations and changing nozzles, and permits consistent and uniform application of such two-component materials without potentially damaging "over spray" and without requiring cleaning of the interior passageways of the dispenser to avoid solidification of catalyzed material in the dispenser.

The variation in flow between angled outboard nozzle passageways and a central nozzle passageway can be effected by variable flow control means other than the preferred flow splitter 22 illustrated and described above. In a more complex system, separate flows of liquid material can be controlled and directed through the angled passageways and central passageway of a nozzle such as that described and illustrated above, and in other embodiments, a single flow of liquid material may be controlled by one, or more, flow control elements carried by the apparatus adjacent the nozzle, to variably divide, direct or restrict the flows to the angled passageways and the central passageway of a nozzle such as that described and illustrated above.

While the invention is illustrated and described in its presently known best mode, it will be understood that modifications and variations may be effected without departing from the scope of the novel concepts of this invention and as set forth in the appended claims.

I claim:

1. An airless variable angle liquid dispenser comprising:

a nozzle with a forward face and a dispensing orifice;

a first liquid passageway in the nozzle having a central axis intersecting the dispensing orifice;

a plurality of angled second liquid passageways, each angled second liquid passageway having a central axis intersecting the dispersing orifice and the central axis of the first liquid passageway; and a variable flow means adjustable to vary the flows of liquid entering the first liquid passageway and the plurality of angled second liquid passageways and thereby to vary the angle of the liquid dispensed from the dispensing orifice.

2. The variable angle liquid dispenser of claim 1 wherein the variable flow means comprises a body forming an input passageway to the first passageway and the plurality of angled second passageways, and carrying a flow control member operable to divide the flow of liquid entering the input passageway between the first passageway and the plurality of angled second passageways.

3. The variable angle liquid dispenser of claim 2 wherein said nozzle comprises a nozzle body forming said forward face, said orifice, said first passageway and said plurality of angled second passageways, and said body forming said input passageway rotatably carries said flow control member to permit uniform variable division of the liquid entering the input passageway between the first passageway and the plurality of angled second passageways.

4. The variable angle liquid dispenser of claim 3, wherein said body has a forward portion adopted for sealed engagement with said nozzle body and provides a seal between said first passageway and said plurality of angled second passageways, said forward portion of said body having a first feed passageway between said input passageway and said first passageway of said nozzle body and a second feed passageway between said input passageway and said angled second passageways of said nozzle body, said flow control member being threadably carried by said body to extend variably with respect to an orifice leading to said second feed passageway and provide variable division of flow to said first feed passageway and said second feed passageways.

5. The variable angle liquid dispenser of claim 3 wherein said angled second passageways have diameters of from about 0.04 to about 0.09 inches and have central axes that converge at an included angle of from about 20° to about 50°, and said first passageway has a diameter about 25% to about 75% of the diameters of said angled second passageways bisect the converging central axes of said angled second passageways, said first and angled second passageways forming said dispensing orifice in the forward face of the nozzle.

6. The variable angle liquid dispenser of claim 5, wherein the first passageway has a diameter about 70% of the diameter of said two passageways.

7. The variable angle liquid dispenser of claim 5, wherein the two converging central axes of said two passageways are separated a distance of about 150% of their diameters at the front face of the nozzle.

8. The variable angle liquid dispenser of claim 7, wherein the front face of the nozzle is flat.

9. The variable angle liquid dispenser of claim 7, wherein a cylindrical chamber is formed in the rear of the nozzle body.

10. The variable angle liquid dispenser of claim 9, wherein the nozzle has a length of from about 0.4 to about 0.5 inches from its front face to its rear face and the cylindrical chamber has a depth of about 0.25 inches from the rear face and a diameter of about 0.375 inches.

11. A method for mixing and applying a two-component material comprising the steps of:

providing a flow of a first component;

providing a flow of a second component;

providing a dispensing nozzle with a first passageway and plural angled second passageways converging within the nozzle and forming a single dispensing opening;

mixing the flows of the first and second components to provide a flow of mixed two-component material;

providing a variable flow control means operable to vary flows of mixed two-component material to the first passageway and the plural angled second passageways; and varying the variable flow control means to vary the flows of the two-component material flowing in the first passageway and in the plural angled second passageways and the width of the applied mixed two-component material.

12. The method of claim 11, wherein the flow of mixed two-component material is directed to an input passageway leading to the nozzle, the variable flow control means is provided between the input passageway and the nozzle, and the flows of mixed two-component material flowing in the first passageway and in the plural angled second passageways are varied by variably dividing the flow of mixed two-component material between the first passageway and the plural angled second passageways.

13. The method of claim 12, further comprising the step of directing a flow of solvent through said input passageway and said first and angled second passageways upon the termination of flow of the mixed two-component material.

14. The method of claim 11 wherein said first component is a polyester resin and said second component is a catalyst for said polyester resin.

15. The method of claim 11 wherein the variable flow control means comprises a flow splitter for the flow of mixed two-component material to the first and the plural angled second passageways to variably split the flows of mixed component material into the first passageway and plural angled second passageways.

16. A variable angle liquid dispenser comprising:

a nozzle body with a forward face and a dispensing orifice;

a first passageway in the nozzle body having a central axis intersecting the dispensing orifice;

a plurality of angled second passageways in the nozzle body, each angled second passageway having a central axis intersecting the dispensing orifice and the central axis of the first passageway;

a variable flow means body having a rear portion forming an input passageway and having a forward portion adopted for sealed engagement with said nozzle body and providing a seal between said first passageway and said plurality of angled second passageways, said forward portion of the variable flow means body having a first feed passageway between said input passageway and said first passageway of said nozzle body and a second feed passageway between said input passageway and said angled second passageways of said nozzle body, and a valve member being threadably carried by said variable flow means body to extend variably in said input passageway and provide a variable division of liquid flow to said first feed passageway and said second feed passageway.

17. The variable angle liquid dispenser of claim 16 wherein said input passageway includes an entry orifice to said second feed passageway, and said valve member has an end variably extendible into said entry orifice to provide a variable restriction of flow to said second feed passageway.

18. The variable angle liquid dispenser of claim 17, wherein the end of the valve member is angled.

19. The variable angle liquid dispenser of claim 16, wherein the plurality of angled second passageways have diameters of from about 0.04 to about 0.09 inches and have central axes that converge at an included angle of from about 20° to about 50°, said first passageway has a diameter about 25% to about 75% of the diameters of said angled second passageways, bisects the converging central axes of said angled second passageways, said first and angled second passageways forming said dispensing orifice in the forward face of the nozzle.

20. The variable angle liquid dispenser of claim 19, wherein the first passageway has a diameter about 70% of the diameter of said two passageways.

21. The variable angle liquid dispenser of claim 19, wherein the front face of the nozzle is flat.

22. The variable angle liquid dispenser of claim 16, wherein a cylindrical chamber is formed in the rear of the nozzle body, and said cylindrical chamber mates with the forward portion of the variable flow means body to provide sealed engagement therewith and a seal between said first passageway and said plurality of angled second passageways.

23. A method for mixing and applying a two-component polyester material including a polyester resin and a catalyst therefor, comprising the steps of providing a source of the polyester resin;

providing a source of the catalyst;

providing a dispensing nozzle with three passageways converging within the nozzle and forming a single dispensing opening, two passageways having diameters of from about 0.04 to about 0.09 inches and having their central axes converging at about the nozzle face with an included angle of from about 25° to about 50° and a third passageway having a diameter of about 25 percent to about 75 percent of the diameters of said two converging passageways and bisecting the converging axes of said two passageways;

providing a flow path for the polyester resin from its source to a mixing chamber adjacent to and connected with said three passageways;

providing a flow path for the catalyst from its source to said mixing chamber adjacent to and connected with said three passageways;

controlling the flow rates of the polyester resin and catalyst to provide a catalyst flow rate from about 0.5 percent to about 10 percent of the flow rate of the polyester resin;

mixing the polyester resin and catalyst while flowing in said mixing chamber; and combining the mixed and flowing polyester and catalyst with the three passageways as a mixing substantially planar stream immediately adjacent the dispensing opening for application to a substrate.

24. The method of claim 23 further comprising the step of directing a flow of solvent through said mixing chamber and said three passageways upon the termination of flow of polyester resin and catalyst.

25. The method of claim 23 wherein the two passageways converge at an included angle of about 50° and the third passageway has a diameter of about 70 percent of the diameter of said two passageways, and the polyester resin and catalyst are pressurized from about 120 psi to about 500 psi.

26. A method for mixing and applying a reactive two-component polyester material, comprising the steps of:

providing a source of polyester resin of the two-component polyester material;

providing a source of catalyst of the two-component polyester material;

providing a dispenser with three passageways converging within the dispenser, two passageways having diameters of from about 0.04 to about 0.09 inches and having central axes that converge at an included angle of from about 25° to about 50°, and a third passageway having a diameter of about 25 percent to about 75 percent of the diameters of said two passageways and intersecting and bisecting the converging axes of said two passageways;

connecting said source of polyester resin with a mixing chamber adjacent the three passageways;

connecting said source of catalyst with said mixing chamber adjacent said three passageways;

pressurizing the polyester resin and catalyst and providing a catalyst flow rate from about 0.5 percent to about 10 percent of the flow rate of the polyester resin;

mixing the polyester resin and catalyst while flowing in said mixing chamber; and directing the mixed and flowing polyester resin and catalyst with said three passageways for combination and further mixing as an expanding stream for application on a substrate.

27. The method of claim 26 wherein said three passageways form a single dispensing opening and direct the mixed polyester and catalyst for combination and mixing immediately adjacent the dispensing opening.

28. The method of claim 27 further comprising the step of directing a flow of compressed air through said mixing chamber and said three passageways upon the termination of flow of the polyester resin and catalyst.

29. The method of claim 26 wherein the two passageways converge at an included angle of about 40° and have diameters of about 0.07 to about 0.08 inches, the third passageway has a diameter of about 70 percent of the diameters of said two passageways, and the polyester resin and catalyst are pressurized from about 300 psi to about 500 psi.

30. The method of claim 26 comprising the step of directing a flow of solvent for the polyester resin and catalyst through the mixing chamber and three passageways.

* * * * *